United States Patent [19]

Paulson et al.

[11] Patent Number: 4,591,821

[45] Date of Patent: May 27, 1986

[54] CHROMIUM-SILICON-NITROGEN THIN FILM RESISTOR AND APPARATUS

[75] Inventors: Wayne M. Paulson, Paradise Valley; David W. Hughes, Mesa, both of Ariz.

[73] Assignee: Motorola, Inc., Schaumburg, Ill.

[21] Appl. No.: 660,602

[22] Filed: Nov. 19, 1984

Related U.S. Application Data

[62] Division of Ser. No. 466,234, Feb. 14, 1983, Pat. No. 4,510,178, which is a division of Ser. No. 279,130, Jun. 30, 1981, Pat. No. 4,392,992.

[51] Int. Cl.[4] ..... H01C 1/012

[52] U.S. Cl. ..... 338/308; 338/309; 118/715

[58] Field of Search ..... 338/308, 309; 118/63, 118/627, 715; 252/512, 513; 204/192

[56] References Cited

U.S. PATENT DOCUMENTS

| | | | |
|---|---|---|---|
| 3,203,830 | 8/1965 | Ostrander et al. | 117/352 |
| 3,345,210 | 10/1967 | Wilson | 117/212 |
| 3,394,087 | 7/1968 | Huang et al. | 252/512 |
| 3,763,026 | 10/1973 | Cordes | 204/192 |
| 3,847,658 | 11/1974 | Kumagai | 117/201 |
| 3,996,551 | 12/1976 | Croson | 338/309 |
| 4,042,479 | 8/1977 | Yamazaki et al. | 338/308 X |
| 4,079,349 | 3/1978 | Dorfeld | 338/9 |
| 4,298,505 | 11/1981 | Dorfeld et al. | 252/513 |

FOREIGN PATENT DOCUMENTS

| | | | |
|---|---|---|---|
| 50-38200 | 12/1975 | Japan | 338/308 |

*Primary Examiner*—C. L. Albritton
*Assistant Examiner*—M. M. Lateef
*Attorney, Agent, or Firm*—Robert M. Handy

[57] ABSTRACT

Improved thin film resistors and electrical devices and circuits with thin film resistors are fabricated utilizing a chromium, silicon, and nitrogen compound formed preferably by rf reactive sputtering of chromium and silicon in a nitrogen bearing atmosphere. An annealing step is used to produce time-stable resistance values and in combination with variations in the partial pressure of nitrogen during sputter deposition to control the temperature coefficient of resistivity to have positive, negative or zero values.

26 Claims, 12 Drawing Figures

CHROMIUM-SILICON-NITROGEN THIN FILM RESISTOR AND APPARATUS

This is a division of application Ser. No. 466,234, filed Feb. 14, 1983 as a divisional of application Ser. No. 279,130, filed June 30, 1981 now U.S. Pat. No. 4,510,178 which issued as U.S. Pat. No. 4,392,992 on July 12, 1983.

BACKGROUND OF THE INVENTION

1. Field of the Invention

This invention relates, in general, to resistors, and more particularly to the formation, composition, and use of an improved ternary intermetallic compound as a thin film resistor material on electronic devices, especially with semiconductor devices, and further, to improved semiconductor devices and circuits incorporating this resistor material.

2. Description of the Prior Art

Resistors are widely used in electronic devices to inhibit the flow of electric current. Frequently, resistors in thin film form are combined with semiconductor devices to make extremely compact, yet complex structures. The thin film resistors may be a part of an individual device, as for example, an emitter ballast resistor in a power transistor, or they may be used in connection with a multiplicity of semiconductor devices to form a more complex electrical function such as in a hybrid or integrated circuit. A resistive divider network in an analog-to-digital converter, or current limiting and load resistors in an emitter follower amplifier, are examples of applications wherein thin film resistors are used in complex hybrid and/or integrated circuits.

Film resistors are usually characterized in terms of their sheet resistivity and their temperature dependence. Sheet resistivity is expressed in resistance per unit area (e.g. ohms per square) and is equal to the bulk resistivity divided by the film thickness. Resistivity is a material property and is not dependent on the topology of a particular resistor. The resistance of a specific resistor is obtained by multiplying the sheet resistivity by the ratio of the resistor length to width.

For compact devices and circuits, especially complex integrated circuits (IC's), it is generally desired that film resistor materials have a sheet resistivity greater than 100 ohms per square, with 500 to 1500 ohms per square being a particularly convenient range for many applications. Examples of prior art film resistor materials and their typical ranges of sheet resistivities (expressed in ohms per square and given in parenthesis following each composition) are: Ni-Cr (40–400); Cr-Si (100–5000); Ta (100–1000); and Cr-SiO (100–1000).

The temperature dependence of the thin film resistors is described in terms of the temperature coefficient of resistivity (TCR) which reflects the slope of the resistivity versus temperature curve, that is, the fractional change in resistance per unit change in temperature. It is usually expressed in parts per million change per degree centigrade (ppm per °C.). The TCR may be positive or negative and may vary with temperature. Prior art film resistor materials typically have TCR's of the order of a few hundred to a few thousand parts per million per degree C., positive or negative, and varying with temperature. Both the resistivity and the TCR can be sensitive to the choice of material, method of preparation, substrate surface, ambient atmosphere, and annealing (heat treatment) subsequent to formation.

It is desired that resistor materials be readily prepared in controlled thicknesses and convenient resistivities, be easily patterned and dimensionally stable, be amenable to the formation thereon of low resistance, void free, and stable contacts, be compatible with other steps essential to the overall circuit or device manufacturing process, and have electrical characteristics which are stable over long periods of time. It is further desired that the TCR be controllable, that is, have a value which is substantially independent of temperature and which can be selected to have a predetermined positive, negative, or zero value. Zero TCR can generally be achieved only over a very limited temperature range, and usually in connection with a temperture dependent TCR. For example, Cr-Si films can have TCR's of $0\pm50$ ppm per °C., but have been found to have a parabolic variation of resistivity with temperature. It is more convenient to have a TCR which is temperature independent, that is, where the resistivity is a linear function of temperature over the temperature range of interest for most electrical apparatus (e.g. $-55°$ to $+125°$ C.). Some materials, for example Cr-Si, react with or dissolve in commonly used contact metals, such as Al, producing thin spots or voids adjacent to the contacts, with a resulting loss of reliability. It is desirable to avoid this effect. This prior art film resistor materials, preparation methods, and structures do not give film resistors, as far as is known, having the above combination of desirable features.

Accordingly, it is an object of this invention to provide an improved resistor material for electrical circuits and devices.

It is a further object of this invention to provide an improved resistor material for electrical structures which can be readily prepared in convenient resistivities and thicknesses, which is easily patterned, which is dimensionally stable, which is amenable to stable low resistance electrical contacts, which is compatible with other devices or circuit processing steps and materials, which is stable over time and which has a controllable TCR that is substantially independent of temperature or is zero in the temperature range of interest.

It is an additional object of this invention to provide an improved resistor material for electrical devices wherein the TCR can be set to have substantially constant positive, negative, or zero values over a temperature range from $-55°$ to $+125°$ C.

It is a further object of this invention to provide improved semiconductor devices, hybrid or integrated circuits, and resistor chips having thereon improved thin film resistors of predetermined values.

It is an additional object of this invention to provide a resistor film material which does not give rise to voids or thin regions in contact with common contact or interconnect metals such as aluminum.

It is a still further object of this invention to provide processes for the fabrication of improved film resistor materials and resistor structures, and improved devices and circuits utilizing these materials and structures.

SUMMARY OF THE INVENTION

The above and other objects and advantages are achieved in accordance with the present invention wherein there is provided a resistor material comprising a ternary intermetallic compound of chromium, silicon, and nitrogen amenable to having electrical contacts thereto, and further wherein resistors having predetermined resistance values are fabricated by forming a chromium, silicon, and nitrogen compound on a suitable substrate in a predetermined shape and composition, annealing the compound at a predetermined temperature in a controlled atmosphere to regulate and stabilize the desired resistivity and resistance value and temperature coefficient of resistivity, and applying electrical contacts thereto.

According to further aspects of the invention, the resistor material compound is formed by reacting chromium and silicon with a nitrogen-bearing gas, and the annealing step is carried out in a dry ambient by heating to a temperature less than 1000° C.

According to yet further aspects of the invention, the forming step for producing the chromium, silicon, and nitrogen compound is carried out by reactive sputtering of Cr and Si in a nitrogen-bearing gas, and still further, wherein the nitrogen-bearing gas comprises nitrogen and argon in a pressure ratio of 1–20% partial pressure of nitrogen in a predetermined total pressure of argon plus nitrogen.

According to an additional aspect of the invention, the Cr, Si, and nitrogen resistor material compound has a composition of substantially $Cr_xSi_yN_z$ after annealing, where Cr, Si and nitrogen are present in atomic percent ranges of 5 to 75%, 5 to 85%, and 1 to 60%, respectively.

According to a further aspect of the invention, narrower ranges of composition (in atomic percent) of Cr (15–35%), Si (47–83%) and nitrogen (2–18%) are useful with still narrower ranges of Cr (25–29%), Si (55–67%) and nitrogen (8–16%) being preferred.

According to a still additional aspect of the invention, improved semiconductor devices, integrated or hybrid circuits are obtained utilizing the improved Cr, Si, and nitrogen resistor material and resistor regions formed therefrom.

The above and other objects, features, and advantages of the present invention will be more clearly understood from the following detailed description taken in conjunction with the accompanying drawings.

DETAILED DESCRIPTION OF THE DRAWINGS

The thin film resistors of the present invention are formed or deposited on a substrate. As used herein "substrate" refers to a base having a major surface on which a resistive film material is or is to be formed to create resistors, and wherein the major surface comprises an insulating region underlying all or part of the resistor. The base may be a metal, a ceramic, a semiconductor, a plastic, or a combination thereof. The insulating region prevents a conductive base from short circuiting the resistor.

Figure 1:
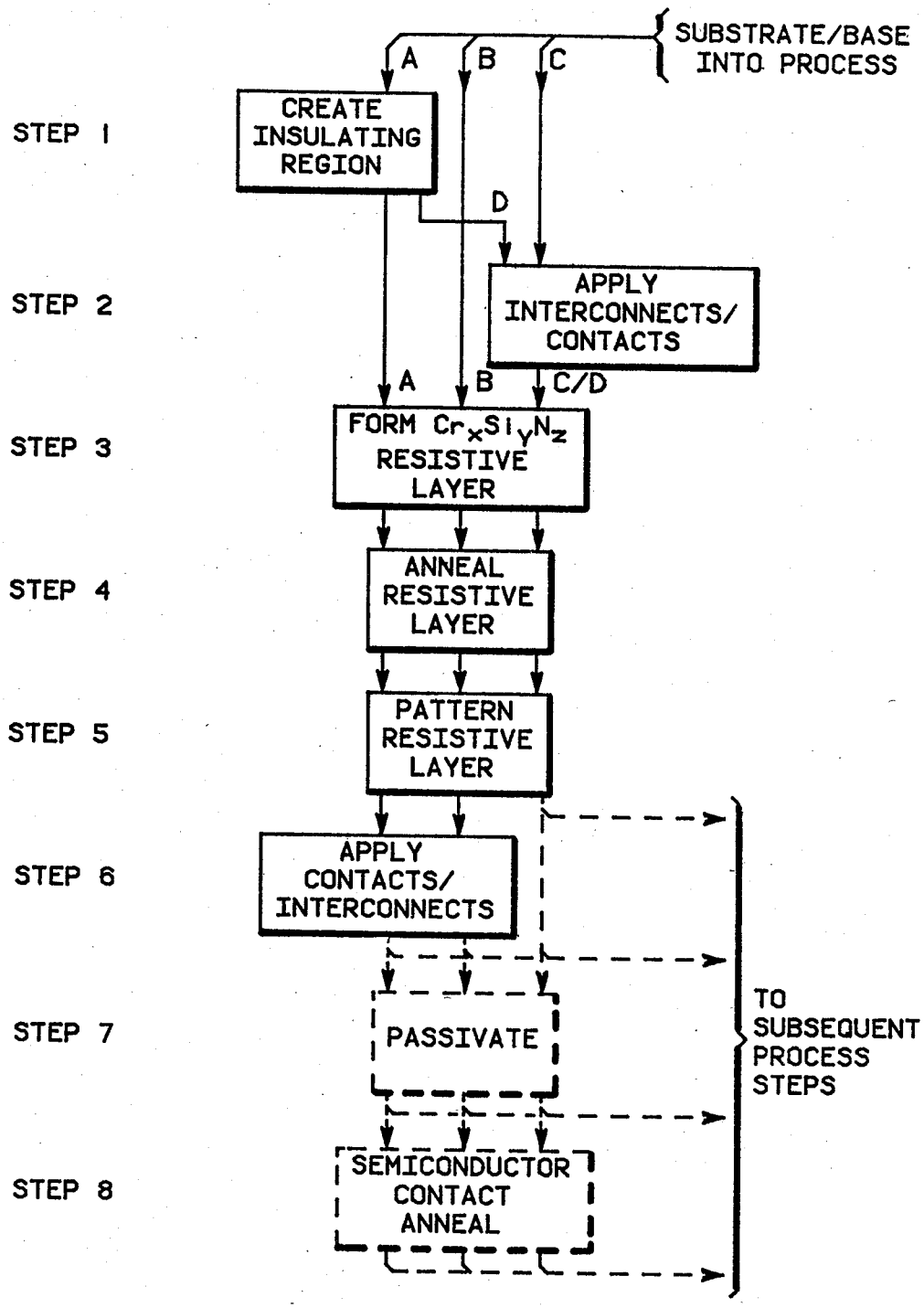
FIG. 1 is a simplified flowchart of several embodiments of the process of the present invention.

FIG. 1 is a simplified flowchart of the process of the present invention according to four embodiments A-D. Alternative embodiments A-D reflect the different types of substrates/bases on which the insulating film materials may be formed, and whether the electrical contacts or interconnections to the resistive film layers are applied before (process flow C or D) or after (process flows A or B) the formation of the resistive layer. A base without an insulating surface region would follow process flow A, whle substrates already having thereon the necessary insulating surface regions would follow process flows B or C. Process flow D is a variation in which a base without an insulating surface region is first provided with such a region and then follows process flow C.

The following example of the practice of the present invention is given for process flow A illustrated in FIG. 1. The process flow is described for the case where the starting base is a semiconductor wafer, particularly silicon. It will be obvious to those of skill in the art that other base/substrate materials could also be used.

In Step 1, an insulating region is created on a major surface of the silicon wafer by forming an insulating layer. $SiO_2$ and/or $Si_3N_4$ layers of approximately 0.1–1 μm thickness prepared by methods well known in the are are useful. The result of step 1 is a silicon wafer (substrate) having an insulating oxide coating as an input to step 3, or, alternatively (process flow D) as an input to step 2.

In step 3, a resistive material layer comprising a compound of chromium, silicon, and nitrogen is formed on the substrate surface. A variety of different processes may be used to form the chromium, silicon, nitrogen compound on the substrate surface, as, for example, chemical vapor deposition, vacuum evaporation, sputtering, reactive sputtering, and/or a combination thereof. Reactive rf sputtering is a preferred technique. It has been found that resistive material layers of useful properties are obtained when the resistive material layer compound has a composition of substantially $Cr_xSi_yN_z$ (measured after annealing step 4) wherein Cr, Si and nitrogen are present in atomic percent ranges of 5 to 75%, 5 to 85%, and 1 to 60% respectively. For high nitrogen content, i.e., above about 18 atomic percent, the film resistivity is large, generally exceeding about 10,000 ohms per square. While useful resistor materials are produced within the above range of compositions, better control of properties is obtained within the narrower range of atomic percent composition of Cr (15–35%), Si (47–83%) and nitrogen (2–18%), giving films of 100–1000 ohms per square with TCR's of ±500 ppm per °C., which are substantially temperature independent over the range −55° to +125° C. A still narrower range of atomic percent compositions Cr (25–29%), Si (55–67%), nitrogen (8–16%) is preferred for obtaining the desired combination of properties discussed previously. For example, films having a nominal atomic percent composition of Cr(27%), Si (65%) and nitrogen (8%) give films of 400–700 ohms per square sheet resistivity having controllable and temperature independent TCR's in the range ±200 ppm per °C. and lower. For any given atomic percent composition of Cr, Si and nitrogen totalling 100%, the corresponding values of x, y, and z can be readily determined by methods well known in the art.

Following formation of the $Cr_xSi_yN_z$ resistive material layer, step 4 is undertaken wherein the resistive material layer is annealed by heatng in a controlled atmosphere in any convenient heating chamber. Annealing can be satisfactorily performed in inert, reducing, or dry oxidizing ambients. Examples of gases giving satisfactory annealing behavior are dry oxygen, forming gas, argon, helium, hydrogen, nitrogen and/or mixtures thereof. Nitrogen is preferred. Wet oxygen was observed to produce rapid oxidation of the deposited resistor material film. Annealing stabilizes the resistivity value of the layer against changes during subsequent process steps and use and, as will be subsequently described, permits adjustment of the TCR. The resistivity typically increases during annealing, the change being predictable for a given composition.

The thin film resistive material layer is patterned in step 5 of FIG. 1 to produce resistor regions of the appropriate width and length to give the desired resistance value. This is done, for example, by coating the film with a layer of photoresist, exposing and developing the photoresist by methods well known in the art, and etching to remove the exposed regions of the resistive film material. A suitable etchant comprises (in volume percent) 60–80% phosphoric acid, 4–6% nitric acid, 4–6% acetic acid, 4–20% hydrofluoric acid, and 8–10% water. This etchant gives a preferential etching action for the resistive material layer. However, other etchants can also be used. No special precautions are required in patterning the resistive film material. It will be apparent to those of skill in the art that the resistive material layer can be patterned before or after annealing, i.e. that steps 4 and 5 as shown on FIG. 1 may be interchanged in sequence. It will be further apparent that, while patterning step 5 has been described in terms of a wet etching operation with an organic photoresist mask, other masking and etching procedures may be used. For example, inorganic masks formed from various metals, oxides, or nitrides known in the art may be employed. Similarly, dry etching techniques such as, plasma etching, reactive ion etching, or ion milling known in the art may be employed. It is convenient to use an etchant, such as that given above, which provides a higher etch rate for the resistive material layer than for underlying substrate regions, e.g. silicon oxide or nitride.

In step 6 for process flows A and B, contacts and/or interconnections are applied to the patterned regions of the resistive material layer. Typically, Al of approximately 1.2 μm thickness is evaporated over the whole surface of the wafer, and unwanted portions removed by conventional photoresist and etching processes well known in the art using an etchant which attacks Al preferentially compared to the $Cr_xSi_yN_z$ compound. An etchant suitable for this purpose is a mixture, in volume percent, of 80% phosphoric acid, 5% nitric acid, 5% acetic and 10% water. Other wet or dry etchants can also be used. The resulting structure yields resistor regions of predetermined shape and extent with highly conductive end contacts and/or interconnections to other circuit elements. It was found that voids, thin spots, or pin holes did not form at the juncture of the Al contacts/interconnects with the $Cr_xSi_yN_z$ resistive material layer, unlike prior art materials such as Cr-Si. Contact/interconnect materials other than Al can be used, provided that the mutual solid solubility with respect to the $Cr_xSi_yN_z$ compound is low, so as to avoid thinning of either layer at the periphery of the joint between the resistor region and the metal contact region due to dissolution of one material in the other near the juncture. This can be determined by experimental test.

Following completion of step 6 of FIG. 1, the resistor region of the semiconductor device or integrated circuit on the silicon wafer is fully functional and the wafer may proceed to subsequent process steps leading to finished devices, circuits and/or apparatus. However, it is frequently desirable to deposit an additional insulating and encapsulating film of, for example, silicon dioxide, silicon nitride, a composite thereof, or an organic material over the resistor regions (step 7 of FIG. 1) to passivate the layer, that is, to provide protection against ambient contamination and handling.

If step 6 has been used to simultaneously apply contacts to the resistor film material layers and also to transistor regions on the surface of the semiconductor wafer, it may be desirable to provide a high temperature contact annealing step (step 8 of FIG. 1) to insure good electrical contact between the metallic interconnects or portion of the resistive material layer and semiconductor regions which they contact. This semiconductor substrate-contact annealing step should be carried out at a temperature less than or equal to the temperature of step 4 of FIG. 1. Alternatively, step 4 may be omitted and step 8 serve to anneal both the resistive material and the semiconductor contacts.

It will be apparent to those of skill in the art that many variations are possible upon the basic process illustrated in flow A of FIG. 1, as for example process flow B for the case where the substrate already contains an insulating region to receive the resistive material layer, or is an insulating material such as a ceramic or plastic substrate typically used in hybrid IC's. A further alternative is process flow C wherein the metallic contacts or interconnects are applied to the substrate prior to the formation of the resistive material layer. With process flow C, the metallic contacts and/or interconnects must withstand the annealing step without adverse effects.

It will also be apparent to those of skill in the art that additional process steps may be required in the manufacture of a finished integrated circuit, hybrid circuit, or semiconductor device, or other electrical apparatus utilizing the resistive film materials of the present invention. A significant advantage of the $Cr_xSi_yN_z$ material and method of the present invention is their compatibility with the process steps commonly used in the art for the fabrication of semiconductor devices, circuits and apparatus. An example of this compatibility is the differential etching action which can be obtained wherein metals (e.g. Al) can be preferentially etched in the presence of the $Cr_xsi_yN_z$ compound, and the $Cr_xSi_yN_z$ compound preferentially etched in the presence of dielectrics (e.g. $SiO_2$ and $Si_3N_4$).

Figure 2A:
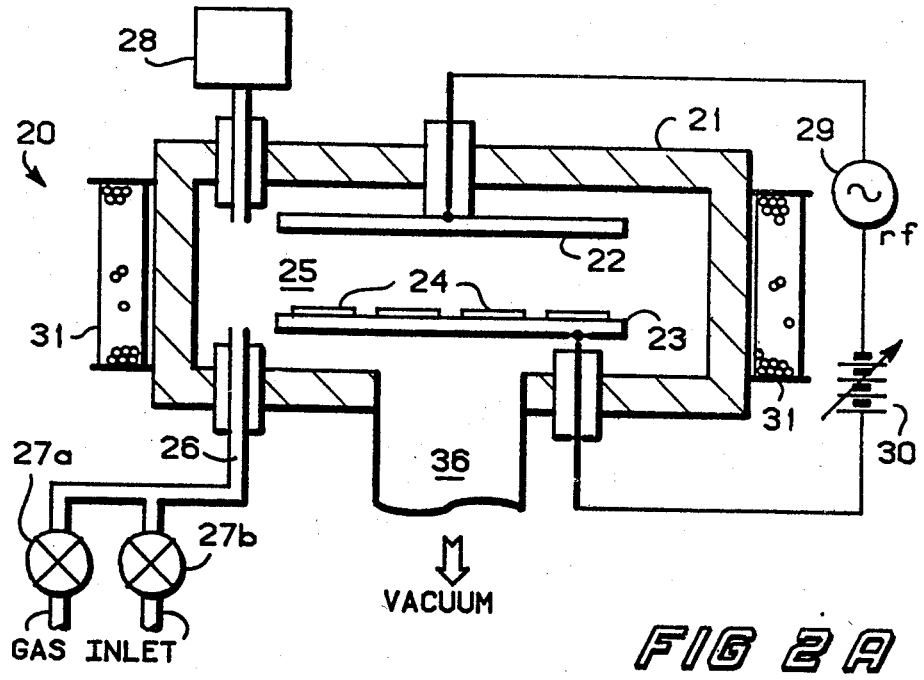
FIG. 2A is a schematic cross-section diagram of a resistor material deposition apparatus used in the practice of the invention.

FIG. 2A is a simplified cross-section diagram of sputter deposition apparatus 20 useful in the practice of the present invention. Deposition apparatus 20 comprises vacuum chamber 21 containing sputtering target 22, and rotatable wafer support platform 23 adapted to support wafers 24. Gas manifold 26 and flow regulator valves 27*a,b* permit a mixture of gases to be introduced into vacuum chamber 21. The absolute pressure within vacuum chamber 21 is measured by pressure gauge 28. Power sources 29 and 30 supply, respectively, rf and dc energy to the interior of vacuum chamber 21 to form a gas plasma in region 25 so as to eject material from target 22 by sputtering. Magnetic coil 31 can be optionally used to confine the plasma to region 25 between plates 22 and 23 to increase the efficiency of the sputtering process. General techniques for dc, rf, and/or reactive sputtering are well known in the art.

As an example of the practice of the method of the invention, substrates in the form of silicon wafers 24 having a 1 μm insulating oxide coating were loaded on platform 23. Vacuum chamber 21 was evacuated to substantially remove the air present therein. Nitrogen was then continuously admitted to chamber 21 through manifold 26 and flow regulating valve 27*a* adjusted to provide a predetermined internal pressure $P_1$ as measured on gauge 28. Argon was then continuously admitted through manifold 26 and its flow rate adjusted by means of regulator 27*b* to achieve a second, higher fixed predetermined pressure $P_2$ as measured on gauge 28, chosen to be convenient for sputtering. The nitrogen partial pressure ($P_1/P_2 \times 100$ percent) was set at various predetermined values.

It was found that rf sputtering (which is preferred) could be achieved with a total pressure $P_2$ in the chamber in the range 4–50 microns (0.5–7 Pa), but that better results would be obtained in the narrower range of 6–20 microns (0.8–3 Pa), with 8–16 microns (1–2 Pa) being preferred for most experimental trials. It was observed that in the preferred range (8–16 microns; 1–2 Pa), other than slight changes in the deposition rate, the properties of the resulting films were substantially independent of the total system pressure. It should be noted that the system is dynamic in that gases ($N_2$ and Ar) are continuously being supplied through manifold 26 and removed through vacuum suction 36. Target 22 was approximately 20 cm in diameter. Rf energy was supplied by rf source 29 to provide a power density at target 22 in the range 0.31–3.1 watts per square centimeter. Under these conditions, deposition rates of the desired chromium-silicon-nitrogen compound in the range of 2–50 nm per minute, typically 20 nm per minute, were obtained. The thickness of the deposited film was readily controlled by varying the deposition time at constant power density and system pressure. Films less than approximately 5 nm thickness were generally not continuous. Films in the thickness range of 40–100 nm were found to be convenient for many integrated circuit applications. Films of any thickness can be deposited. The sheet resistivity is inversely proportional to thickness, dropping as the thickness increases. Above 1000 nm in thickness, differential mechanical stress effects reduce the utility of the resistor films. Target 22 consisted of 27 atomic percent chromium and 73 atomic percent silicon. However, other chromium-silicon ratios can be used.

Figure 2B:
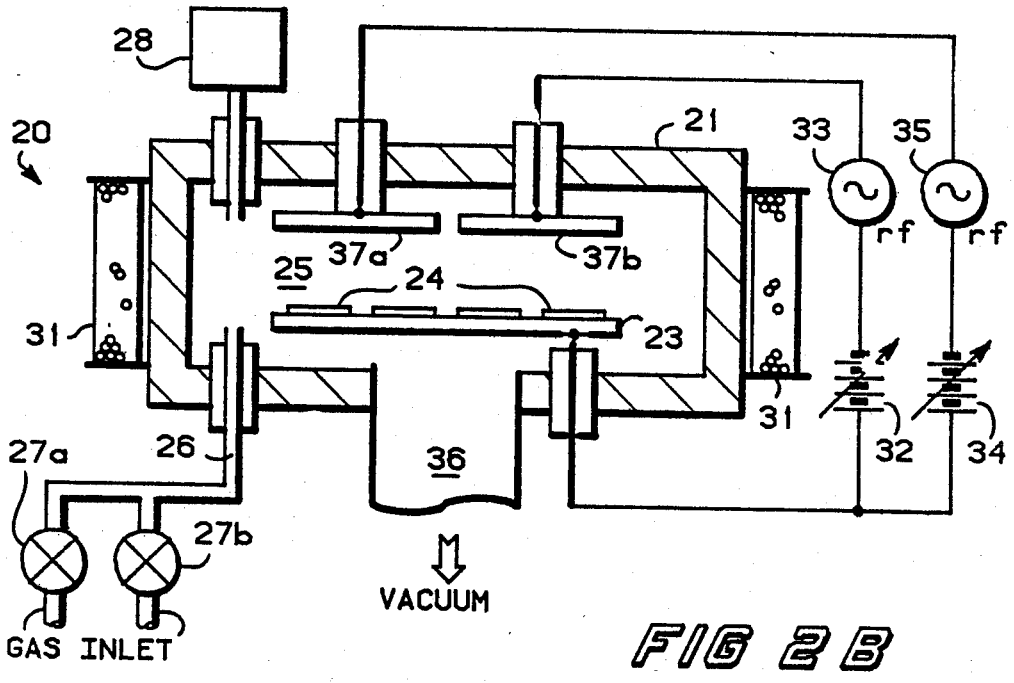
FIG. 2B is an alternative embodiment of the sytem of FIG. 2A using multiple targets.

Alternatively, deposition apparatus 20 may have the configuration shown in FIG. 2B in which composite target 22 has been replaced by separate targets 37*a* and 37*b* of silicon and chromium, respectively. Independent power supplies 32–33 and 34–35 provide energy separately to targets 37*b* and 37*a* so that the sputtering rate from each target can be independently controlled. Rf sputtering is preferred. Rotatable wafer support platform 23 can be turned beneath targets 37*a–b* to insure uniform coverage of wafers 24.

The sheet resistivity obtained, all other things being equal, is a function of the partial pressure of nitrogen during the reactive sputtering deposition procedure. The partial pressure percentage of nitrogen is determined by $(P_1/P_2) \times 100$. The sheet resistivity (measured after anneal), other things being equal, decreases (e.g. from 500 to 400 ohms per square) with increasing nitrogen partial pressure in the range from zero to 6–7%. Above 6–7%, the sheet resistivity increases roughly as the log of nitrogen partial pressure, reaching about 10,000 ohms per square at about 20% nitrogen partial pressure. The approximate relationship between nitrogen partial pressure during film formation and film composition was determined by Auger analysis of annealed films. It was found that 1% nitrogen partial pressure gave film having approximately $2 \pm 1$ atomic percent nitrogen and 10% nitrogen partial pressure gave films having about $18 \pm 2$ atomic percent. The relationship was approximately linear between these values. Extrapolating to 20% nitrogen partial pressure gives a predicted $34 \pm 5$ atom percent nitrogen. Nitrogen contents as high as about 60 atomic percent are believed possible.

Figure 3:
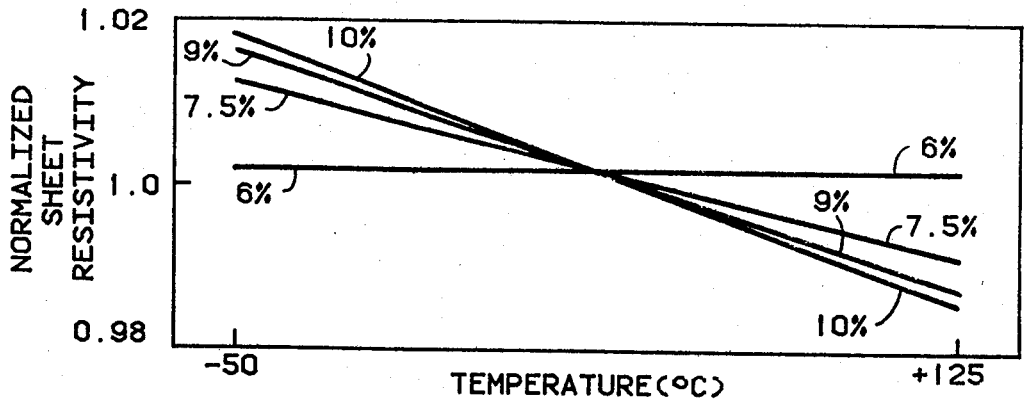
FIG. 3 is a graph showing the temperature dependence of the normalized sheet resistivitly of the material of the present invention for different values of the partial pressure percentage of nitrogen in argon during preparation.

Additionally, the temperature coefficient of resistance (TCR) depends upon the nitrogen partial pressure as illustrated in FIG. 3. FIG. 3 shows the normalized sheet resistivity of a number of different samples prepared at different partial pressures of nitrogen (6–10%) as a function of temperature at which the resistivity is measured in the range $-50°$ to $+125°$ C. The normalized sheet resistivity is the measured sheet resistivity at a selected temperature divided by the sheet resistivity at 25° C. The 6% film had a nominal resistivity of approximately 550 ohms per square at 25° C. It will be noted that the normalized sheet resistivity varies linearly with temperature, i.e. that the TCR is constant and varies from approximately zero (for 6% nitrogen partial pressure) to small negative values (for 10% nitrogen partial pressure). These samples were all subjected to the same annealing treatment (i.e., one hour at 525° C. in dry nitrogen).

Figure 4:
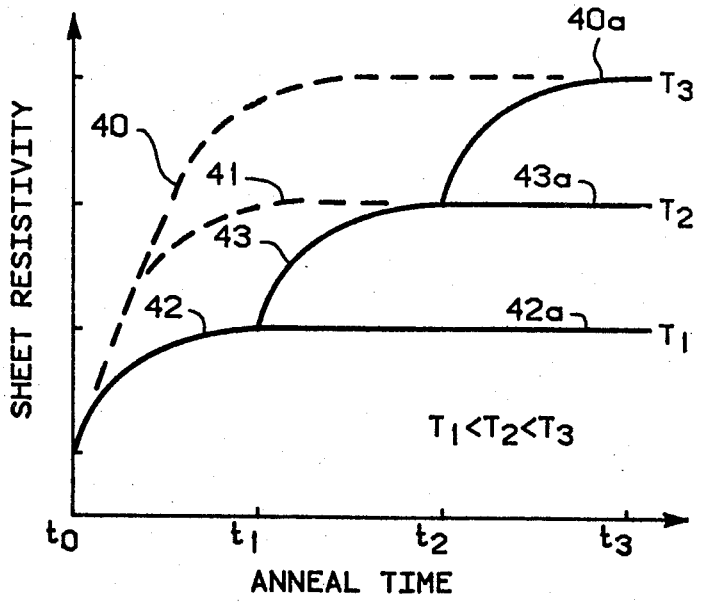
FIG. 4 is a graph showing the variation of sheet resistivity of the material of the present invention as a function of annealing time for different annealing temperatures.

Typical annealing behavior of a film is shown in FIG. 4 which is a graph of the sheet resistivity as a function of annealing time for different annealing temperatures. Annealing temperatures below approximately 1000° C. were found to produce satisfactory results, with 400° to 800° C. being preferred. Annealing times in the range of a few minutes to several hours were found to give satisfactory results. The change in resistivity is very rapid during the first few minutes of annealing. To a first approximation, for films having the same initial resistivity and composition, the final (post anneal) resistivity depends principally on the temperature. Typically, the higher the temperature the higher the value of final resistivity achieved, as can be seen from lines 40–42 of FIG. 4. For example, if anneal temperature $T_1$ is chosen, the sheet resistivity will rise according to curve 42–42*a* and rapidly achieve a stable value 42*a*. However, if during subsequent device processing, the resistor film material is subjected to a higher temperature $T_2$, the sheet resistivity will undergo a further increase as shown by line 43 achieving a higher steady value 43*a*. This process will continue each time the resistor film material is exposed to a higher temperature (e.g. $T_3$). It is thus desirable to choose an annealing temperature which equals or exceeds any temperature to which the resistor film material will be subjected during subsequent device processing or use. In this way, the sheet resistivity is brought directly (e.g. along 40–40*a*) to a stable value and remains there substantially indefinitely.

Figure 5A:
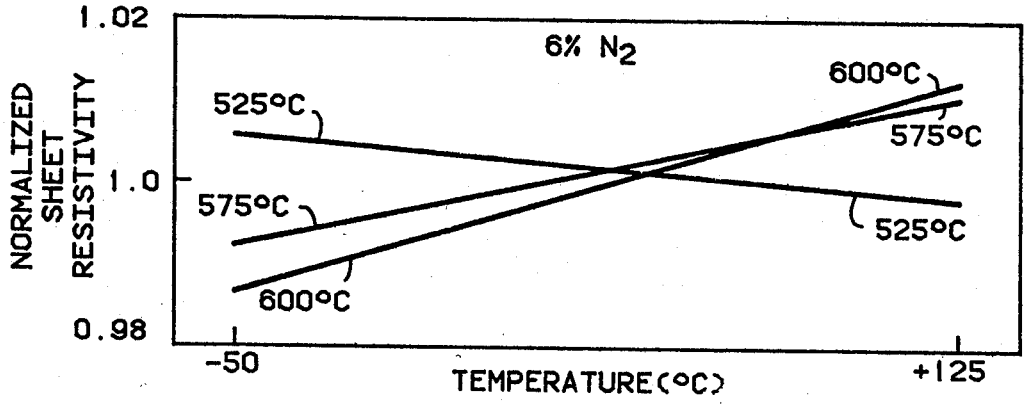
FIG. 5A is a graph of the normalized sheet resistivity as a function of temperature for resistor material samples prepared with 6% partial pressure of nitrogen in argon and subsequently annealed at several different temperatures.
Figure 5B:
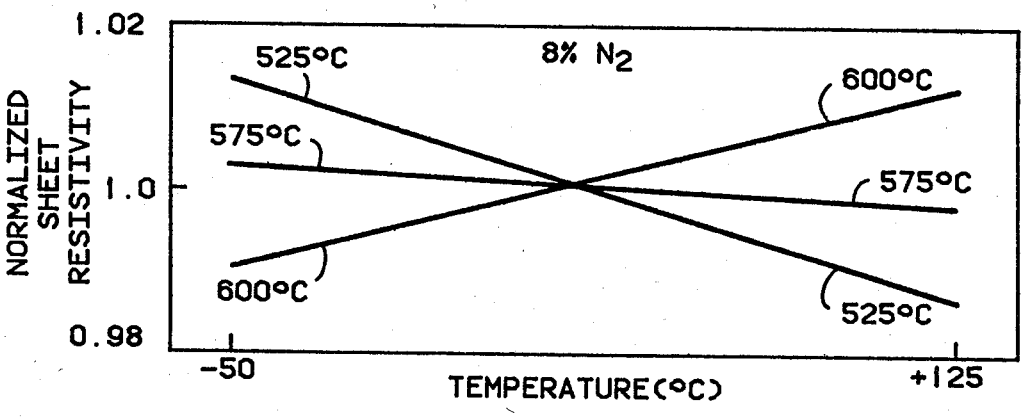
FIG. 5B is a graph of the normalized sheet resistivity as a function of temperature for resistor material samples prepared with 8% partial pressure of nitrogen in argon and subsequently annealed at several different temperatures.

In FIGS. 5A and 5B, the composite effect of varying the partial pressure of nitrogen during deposition of the film and varying the post deposition annealing temperature are illustrated, wherein the normalized sheet resistivity is plotted as a function of the temperature at which the resistivity is measured. In FIG. 5A are shown data for films prepared at 6% partial pressure of nitrogen which have been annealed at 525°, 575°, and 600° C. The TCR changes from small negative values to small positive values as the post deposition annealing temperature is changed. In each case the TCR is constant so that the sheet resistivity varies linearly with temperature. In FIG. 5B are shown the data for films prepared at 8% partial pressure of nitrogen and annealed at the same temperatures of 525°, 575°, and 600° C. The same general type of behavior is observed as in FIG. 6A. These films had a nominal sheet resistivity of approximately 550 ohms per square.

Below about 6% partial pressure of nitrogen, particularly for values near 1% partial pressure, the normalized sheet resistivity begins to show non-linear dependence on temperature and, as the nitrogen partial pressure approaches zero, increasingly exhibits the parabolic behavior of many of the prior art materials (e.g. Cr-Si). Above about 10% partial pressure of nitrogen the sheet resistivity increases rapidly to very large values.

The method and material combination of the present invention provide a flexible system by which a variety of different sheet resistivities and TCR's can be achieved. For example, the following primary variables can be utilized:

(1) The general value of resistivity is determined by selecting the thickness of the layer and the percentage partial pressure of nitrogen during depostion. It is desirable that the partial pressure of nitrogen be maintained in the range 6–10% in order to achieve convenient TCR properties, although higher or lower values can be used.

(2) The annealing temperature for annealing the resistive film material is chosen to equal or exceed any temperature to which the circuit will be subject in further processing and use. this annealing causes an experimentally determinable change in resistivity which can be taken into account in selecting the initial film thickness and nitrogen partial pressure percentage so as to obtain the desired final value of sheet resistivity.

(3) The specific value of anneal temperature (e.g. 575±25° C.) can be selected in conjunction with the nitrogen partial pressure percentage in order to obtain the desired TCR, that is, positive, negative, or zero, so that the resistivity remains unchanged or varies in a predictable linear fashion with temperature. The interrelationships among the several variables are determined by experiment so that the desired combination of properties can be obtained. Sheet resistivities in the range 100–1000 ohms per square are readily obtained with 400–700 ohms per square being preferred.

Figure 6A:
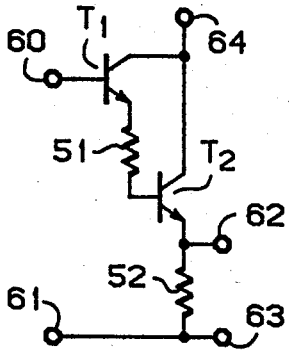
FIG. 6A is a circuit diagram of a two stage amplifier having two resistors.

FIG. 6A is a circuit diagram of a two stage transistor amplifier with two resistors. The circuit of FIG. 6A has input terminals 60 and 61, output terminals 62 and 63, first transistor T1 and second transistor T2. Thin film series resistor 51 formed from a Cr-Si-N resistive material layer is connected from the emitter of T1 to the base of T2. Thin film emitter resistor 52 formed from a Cr-Si-N resistive material layer is connected from the emitter of T2 to the common line joining terminals 61, 63. The collectors of T1 and T2 are connected to power input terminal 64.

Figure 6B:
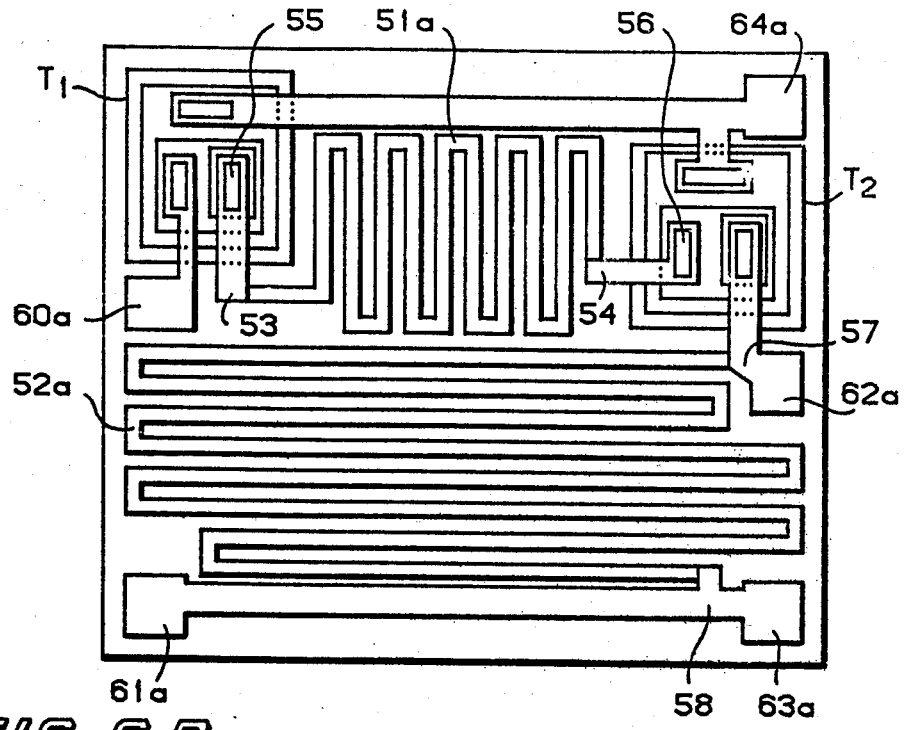
FIG. 6B is a simplified top view of a monolithic integrated circuit implementation of the circuit of FIG. 6A utilizing the resistor material of the present invention.

FIG. 6B shows a top view in simplified form of a topographical layout of a monolithic integrated circuit implementation of FIG. 6A. Metallization region 53 provides interconnection between series resistor region 51*a* and emitter contact 55 of transistor T1. Metallization region 54 provides interconnection to the other end of resistor region 51*a* and to base contact region 56 of transistor T2. In a corresponding way, metallization regions 57 and 58 make contact to the ends of emitter resistor region 52*a*. Metallic contacts or interconnects 53–54 and 57–58 are applied to the end of patterned thin film resistor material regions 51*a*–52*a* according to step 2 or 6 of FIG. 1. Metallization 60*a* connects to the base contact of T1 and 62*a* to the emitter of T2. Metallization 64*a* connects the collector regions of T1 and T2 and corresponds to power input terminal 64. Metallization 61*a*, 63*a* connects to emitter resistor contact metallization 58 and corresponds to terminals 61 and 63 respectively. Metallization 62*a* connects to emitter resistor contact metallization 57, and the emitter of T2 and corresponds to output 62.

Figure 6C:
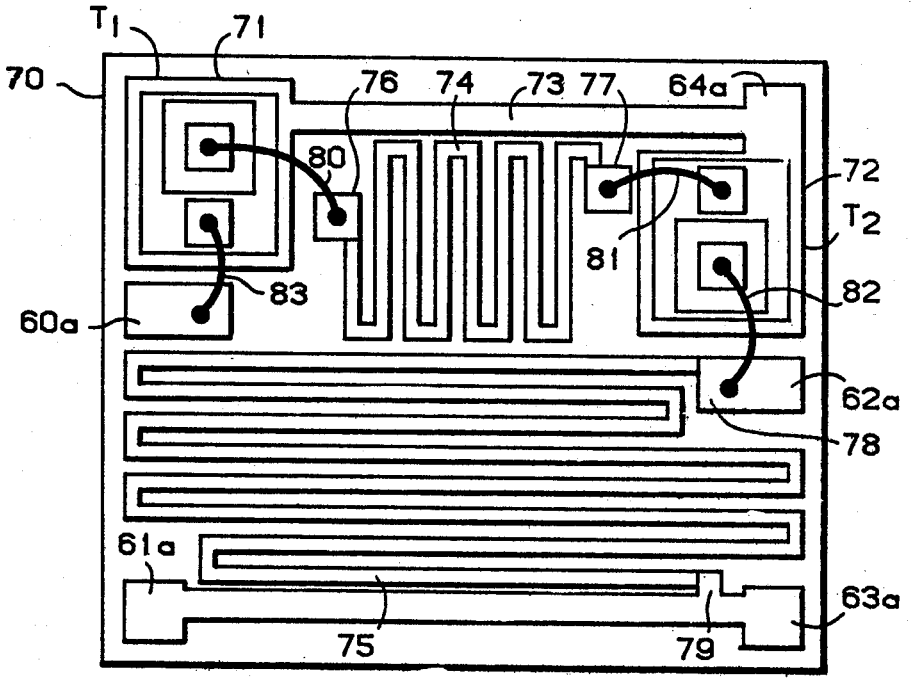
FIG. 6C is a simplified top view of a hybrid integrated circuit implementation of the circuit of FIG. 6A utilizing the resistor material of the present invention.

FIG. 6C shows the same circuit of FIG. 6A but constructed as a hybrid integrated circuit on a ceramic substrate 70 and including individual transistor chips 71 (T1) and 72 (T2) which are fixed by their collectors to metalllization region 73 lying on substrate 70 and coupled to pad 64*a* corresponding to terminal 64. Thin film resistor regions 74–75 formed from a Cr-Si-N resistive material layer have metallic contacts 76–77 and 78–79 respectively. Wire bonds 80–83 are used to couple the resistors to transistors T1 and T2 and to input 60*a* and output 62*a* of the circuit which correspond to input 60 and output 62 of FIG. 6A.

Figure 7A:
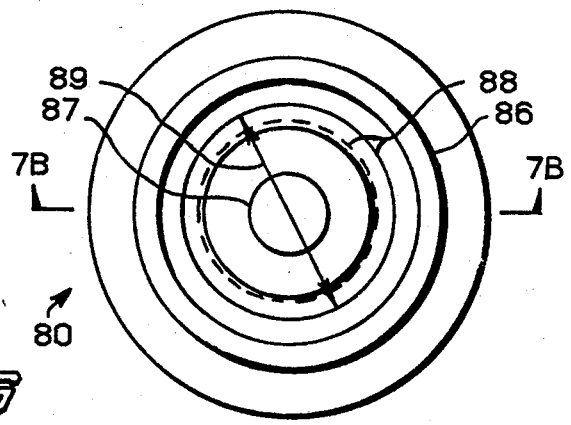
FIG. 7A is a top view in simplified form of a semiconductor device utilizing the resistor material of the present invention.
Figure 7B:
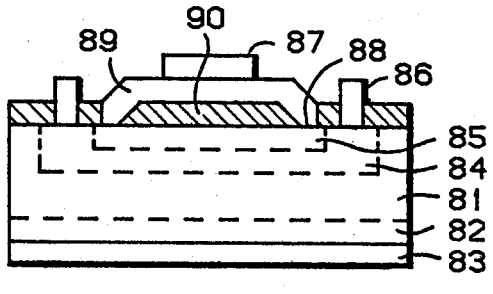
FIG. 7B is a cross-section in simplified form of the device of FIG. 7A.

FIG. 7A shows a top view and FIG. 7B a cross-section of a semiconductor transistor device 80 comprising semiconductor body 81, collector region 82, collector contact 83, base region 84, emitter region 85, base metallization 86, emitter contact region 88, and resistive film material layer 89 of the present invention which couples emitter contact region 88 and emitter metallic contact 87 so as to provide series emitter resistance. Insulating oxide region 90 supports resistive film material layer 89.

Thus, there has been provided by the present invention an improved resistor material for electrical circuits and devices which can be readily prepared in convenient resistivities and thicknesses, which is easily patterned, which is dimensionally stable, which is amenable to stable low resistance electrical contacts without forming voids or thin regions in or adjacent to the contact, which has a controllable temperature coefficient of resistance adjustable to positive, negative, or zero values in the temperature range of interest, which is compatible with other device or circuit processing steps and materials and which is stable over time. There has been further provided improved semiconductor devices, hybrid and/or integrated circuits having thereon improved thin film resistors of predetermined values. Additionally, there has been provided an improved process for the fabrication of an improved film resistor material and resistor structures, and improved devices and circuits utilizing these resistor materials and structures.

While the present invention has been described principally in terms of an exemplary substrate/base material, that is, silicon semiconductor wafers, it will be apparent to those of skill in the art that the methods, materials, and concepts apply to a wide range of substrate/base materials such as, other semiconductors, insulating ceramics, glasses, metallic members provided with insulating regions thereon, and plastics with and without metallic regions thereon. While the maximum permissible temperature of these several substrates may vary, the chrome-silicon-nitrogen compound resistor material of the present invention can be formed thereon, patterned, and contacted. Accordingly, it is intended to encompass all such variations which fall within the spirit and scope of the present invention.

We claim:

1. A thin film resistor for impeding the flow of electrical current, comprising:

a substrate for supporting said thin film resistor;

a thin film resistor material region formed on said substrate, said material region comprising a substantially nickel free compound of Cr, Si, and nitrogen, wherein said material region is fomred by reacting Cr and Si with a nitrogen bearing gas and wherein said material region is annealed by heating in a dry ambient atmosphere at a temperature less than 1000° C.; and conductive contacts formed on said material region to permit electrical connections thereto.

2. The resistor of claim 1 wherein said material region is formed by reactive sputtering of Cr and Si in a nitrogen bearing gas.

3. The resistor of claim 2 wherein said nitrogen bearing gas comprises argon containing 1–20% partial pressure of nitrogen.

4. The resistor of claim 2 wherein said material region is annealed in an atmoshere of $N_2$, $O_2$, hHd 2, Ar, He, or dry mixtures thereof.

5. The resistor of claim 4 wherein said material region has a composition after annealing in the range of, expressed in atomic percent, Cr (5–75%), Si (5–85%) and nitrogen (1–60%) totalling substantially 100 percent.

6. The resistor of claim 4 wherein said material region has a composition after annealing in the range of, expressed in atomic percent, Cr (15–35%), Si (47–83%) and nitrogen (2–18%) totalling substantially 100 percent.

7. The resistor of claim 4 wherein said material region has a composition after annealing in the range of, expressed in atomic percent, Cr (25–29%), Si (55–67%) and nitrogen (8–16%) totalling substantially 100 percent.

8. The resistor of claim 5 wherein said material region has a thickness greater than 5 nm.

9. The resistor of claim 8 wherein said material region has a thickness in the range 5–1000 nm.

10. The resistor of claim 9 wherein said material region has a thickness in the range 40–100 nm.

11. An electrical apparatus comprising a resistor material on a surface, made according to the process of:

exposing said surface to one or more sources of Cr, Si, and nitrogen wherein at least one of said sources of Cr, Si, nitrogen, or combinations thereof is gaseous;

forming on said surface a thin film comprising a compound of Cr, Si, and nitrogen derived from said sources;

wherein said forming step comprises preparing a compound having a composition after annealing in the range of, expressed in atomic percent, Cr (5–75%), Si (5–25%), and nitrogen (1–60%) totalling substantially 100%; and annealing said thin film to produce said resistor material.

12. The apparatus of claim 11 wherein said forming step comprises preparing a compound having a composition after annealing in the range of CR (15–35%), Si (47–83%), and nitrogen (2–18%) expressed in atomic percent.

13. The apparatus of claim 11 wherein said forming step comprises preparing a compound having a composition after annealing in the range of Cr (25–29%), Si (55–67%), and nitrogen (8–16%) expressed in atomic percent.

14. The apparatus of claim 11 wherein said annealing step comprises heating said thin film to a temperature less than 1000° C. in a dry atmosphere.

15. The apparatus of claim 14 wherein said atmosphere comprises $N_2$, $O_2$, $H_2$, Ar, He, or dry mixtures thereof.

16. The apparatus of claim 15 wherein said forming step comprises reactive sputtering of Cr and Si in a nitrogen bearing gas.

17. The apparatus of claim 16 wherein said nitrogen bearing gas comprises $N_2$ and Ar.

18. The apparatus of claim 17 wherein said forming step comprises rf reactive sputtering and said $N_2$ and Ar are in a pressure ratio of 1–20% partial pressure of nitrogen in a predetermined total pressure of argon plus nitrogen.

19. The apparatus of claim 18 wherein said total pressure is in the range 4 to 50 microns (0.53 to 6.7 Pa).

20. The apparatus of claim 19 wherein said total pressure is in the range 6 to 20 microns (0.8 to 2.7 Pa).

21. The apparatus of claim 20 wherein said reactive sputtering step includes depositing a layer comprising Cr, Si, and nitrogen having a thickness in the range 40 to 100 nm.

22. The apparatus of claim 21 wherein said heating step is carried out between 400° and 800° C.

23. The apparatus of claim 22 wherein said substrate comprises a semiconductor.

24. The apparatus of claim 22 wherein said surface has thereon an insulator layer.

25. The apparatus of claim 24 wherein said insulator layer comprises silicon oxide.

26. The apparatus of claim 25 wherein said insulator layer comprises silicon oxide and an outer layer of silicon nitride.

* * * * *